US007207443B2

(12) United States Patent
Von Merveldt

(10) Patent No.: US 7,207,443 B2
(45) Date of Patent: Apr. 24, 2007

(54) BULK BAG

(75) Inventor: Alf Bernd Michael Von Merveldt, Randburg (ZA)

(73) Assignee: Tellap, Inc., Arlington, VA (US)

( * ) Notice: Subject to any disclaimer, the term of this patent is extended or adjusted under 35 U.S.C. 154(b) by 366 days.

(21) Appl. No.: 10/774,998

(22) Filed: Feb. 9, 2004

(65) Prior Publication Data

US 2004/0159565 A1 Aug. 19, 2004

(30) Foreign Application Priority Data

Feb. 13, 2003 (ZA) ..... 2003/1190

(51) Int. Cl.
*B65D 19/00* (2006.01)

(52) U.S. Cl. ..... 206/599; 206/386; 206/595; 206/596; 383/16

(58) Field of Classification Search ..... 206/386, 206/595–600; 383/16, 32
See application file for complete search history.

(56) References Cited

U.S. PATENT DOCUMENTS

| | | | | |
|---|---|---|---|---|
| 3,329,103 | A * | 7/1967 | Cohen | 108/54.1 |
| 4,274,540 | A * | 6/1981 | Coles et al. | 206/597 |
| 4,714,026 | A * | 12/1987 | Yamaguchi et al. | 108/57.29 |
| 4,846,392 | A | 7/1989 | Hinshaw | |
| 5,785,175 | A | 7/1998 | Cholsaipant | |
| 6,041,718 | A * | 3/2000 | Brandes et al. | 108/51.3 |
| 6,213,305 | B1 * | 4/2001 | Baker et al. | 206/599 |
| 6,467,625 | B2 | 10/2002 | Baker et al. | |
| 6,533,121 | B1 * | 3/2003 | Ross | 206/599 |

(Continued)

FOREIGN PATENT DOCUMENTS

| | | |
|---|---|---|
| DE | 10 37 965 | 8/1958 |

(Continued)

OTHER PUBLICATIONS

International Search Report for PCT/IB2004/000297 mailed on Sep. 6, 2004.

Written Opinion for PCT/IB2004/000297 mailed on Sep. 6, 2004.

*Primary Examiner*—Mickey Yu
*Assistant Examiner*—Steven Pollicoff
(74) *Attorney, Agent, or Firm*—Meyertons, Hood, Kivlin, Kowert & Goetzel, P.C.; Eric B. Meyertons

(57) ABSTRACT

A bulk bag having side walls; and a bottom wallis provided wherein a pair of laterally spaced generally flexible sleeves are associated with the bottom wall with each sleeve operatively receiving a generally rigid tubular element adapted to receive a tine of a forklift truck, in use. Each tubular element preferably has, at one end thereof, outwardly directed flange formations for preventing movement of the said end into the sleeve, in use, and means at the other end for inhibiting movement of said other end into the sleeve, in use. The tubular element is preferably made to a generally rectangular cross-sectional configuration from a flat sheet of material bent along the corners to define said tubular element. The flat sheet of material is preferably an extruded sheet of plastics material having a series of integral spaced parallel webs or ribs of material strengthening the sheet in which case bends defining the corners of said generally rectangular cross-sectional configuration extend at substantially right angles to the length of said webs or ribs.

10 Claims, 4 Drawing Sheets

U.S. PATENT DOCUMENTS

| | | | | |
|---|---|---|---|---|
| 6,935,500 | B1 * | 8/2005 | Schnaars | 206/386 |
| 2001/0027826 | A1 | 10/2001 | Carpenter | |

FOREIGN PATENT DOCUMENTS

| | | | |
|---|---|---|---|
| DE | 10 92 372 | | 11/1960 |
| DE | 197 40 323 | | 3/1999 |
| EP | 0080126 | A1 | 6/1983 |
| GB | 2161452 | A | 1/1986 |
| WO | WO-00/73174 | A1 | 12/2000 |
| WO | WO-02/081340 | A1 | 10/2002 |

* cited by examiner

BULK BAG

FIELD OF THE INVENTION

This invention relates to bulk bags widely used for transporting bulk commodities from one place to another and wherein the filled bulk bags are often packed into shipping containers or closed road or rail transport vehicles (herein collectively referred to generally as a transport containers).

BACKGROUND TO THE INVENTION

Bulk bags are becoming increasingly popular for the purpose of transporting commodities that range from mined ores and minerals, in either granular or lumpy form, to agricultural products, chemicals, small hardware components and small packages of many different small products.

For the purpose of stacking filled bulk bags into transport containers it is generally advantageous to move the filled bags using a forklift truck. It has long been realised that lifting a filled bulk bag from the top restricts the height to which bags can be stacked in a transport container because of the restriction imposed by the roof of the container.

As a result, many different proposals have been made to provide a pair of laterally spaced, effectively rigid tubular elements at the bottom of a bag that are configured to receive the tines of a forklift truck so that lifting can take place from the bottom of the bag. This enables a filled bulk bag to be lifted almost to roof height within a transport container.

The earliest proposal of this nature known to applicant is European patent publication number EP 0080126 to Norsk Hydro AS wherein a pair of spaced tubular battens, that could be a plastic pipe or the like, are positioned between two layers of a bottom to the bag.

U.S. Pat. No. 5,785,175 proposes a bulk bag with a base that is configured to receive the tines of a forklift truck, many different configurations of base being disclosed. These bases occupy volume with a corresponding decrease in available space for load and would also be rather costly to manufacture as they must be rather strong.

British patent GB 2,161,452 discloses an arrangement in which tubular elements in the form of box sectioned reinforcing members are provided for receiving the forklift tines, one variation of which is made of wooden planks and slats with an alternative proposal being a plastics extrusion. Timber is costly; very much out of fashion; and even not accepted in some destinations, unless properly treated. Extrusions would have to be rather robust to withstand the substantial transverse forces imposed on them and extrusion of a tubular element does not allow for reinforcing ribs to be formed transverse to the length of the element.

U.S. Pat. Nos. 6,213,305 and 6,467,625 and corresponding publications disclose a number of different bulk bags having flexible sleeves depending from the bottom of the bag for accommodating forklift tine receiving members. One of the problems addressed by these patents is maintaining the so-called receiving members (that applicant terms tubular elements) within the flexible sleeves and various possibilities are put forward that are based on either elastic regions to the sleeves, typically at the entrances to the sleeves, or involve the clipping of two extrusions together with parts of the sleeves being clamped between the two parts.

Elastic entrances to the sleeves effectively narrow the entrances to the receiving members and make it more difficult for a forklift truck driver to align the free ends of the tines with the openings. This, accordingly, increases the already present possibility that the side of the bag immediately adjacent the entrance to such a tubular element may be damaged by the tines of the forklift truck during attempts to align the tines with the interior of the tubular element. Also, the alternative constructions, namely a pair of cooperating clipping extrusions, are expensive; relatively complicated; and also suffer from the disadvantage that reinforcing ribs transverse to the length of the extrusions cannot be easily formed. The alternative of injection moulding such components is also extremely expensive with die-costs for such large items generally being substantial. Still further, the positioning of the receiving members beneath the bottom of the bag means that they need to be stronger in view of the added weight exerted on them by this configuration, in use.

OBJECT OF THE INVENTION

It is an object of this invention to provide a bulk bag and tubular tine receiving elements that are simple to produce and wherein the maintenance of the members within a flexible sleeve or pocket is achieved in a simple and inexpensive manner and wherein at least some protection may be afforded to a bag at the entrance to a tubular element.

SUMMARY OF THE INVENTION

In accordance with one aspect of the invention there is provided a bulk bag having flexible side walls; a bottom wall configured to define, with the sidewalls, a generally rectangular shape of bag; and a pair of laterally spaced generally flexible sleeves associated with the bottom wall and each of which operatively receives a generally rigid tubular element adapted to receive a tine of a forklift truck, in use, the bulk bag being characterized in that each tubular element has, at one end thereof, outwardly directed flange formations for preventing movement of the said end into the sleeve, in use, and means at the other end for inhibiting movement of said other end into the sleeve, in use.

In accordance with a second aspect of the invention there is provided a bulk bag having flexible side walls; a bottom wall configured to define, with the sidewalls, a generally rectangular shape of bag; and a pair of laterally spaced generally flexible sleeves associated with the bottom wall and each of which operatively receives a generally rigid tubular element adapted to receive a tine of a forklift truck, in use, the bulk bag being characterized in that each tubular element is made to a generally rectangular cross-sectional configuration and is composed of a flat sheet of material bent along the corners of said generally rectangular cross-sectional configuration to define said tubular element.

Further features of the latter aspect of the invention provide for the flat sheet of material to be an extruded sheet of plastics material having a series of integral spaced parallel webs or ribs of material strengthening the sheet in which case the bends defining the corners of said generally rectangular cross-sectional configuration extend at substantially right angles to the length of said webs or ribs; for the bends to be formed by heat softening the material along the lines of the bends and allowing it to cool in the bent condition; for the free longitudinal edges of a sheet of material bent to the said tubular element configuration to overlap and define a double wall at one side of the tubular element; for the sheet material to be an extruded polypropylene, polyethylene, or other plastics material having the configuration of two spaced parallel walls interconnected by a series of parallel integral webs of material; for one end of each tubular element to have integral flange formations formed by bends in the sheet material at right angles to those defining the tubular shape; and for the opposite end of each tubular element to have a perforation through the material for receiving a fastener, in particular a cable tie, for attaching said opposite end to the adjacent wall of the bulk bag.

In each of the two aspects of the invention defined above the laterally spaced sleeves are formed within the general rectangular shape of the bag such that, in use, the bottom of the bag is substantially coplanar with a bottom wall of each of the spaced sleeves. This is most easily achieved by stitching inserts to the inside of the side and bottom walls of the bulk bag to provide a top wall and one side wall to each of the spaced sleeves with a bottom wall and the other side wall of each sleeve being defined by the bottom wall and side wall of the bulk bag itself, apertures being formed at each end of the sleeves for providing for insertion of the tubular elements therein.

The bulk bag is, apart from the aforesaid unique features, made very much along conventional lines and typically of a suitable woven fabric of polypropylene, polyethylene, or polyester strands and mixtures thereof with assembly being carried out utilizing suitable stitching or thermal bonding techniques, or both. The bulk bag may also be provided with any conventional or other features such as a flexible top cover or a flexible funnel inlet at the top; a flexible tubular outlet at the bottom for discharging flowable contents as and when required; and additional lifting handles, typically at the corners.

The invention also provides, as articles of commerce, a bulk bag especially configured to receive tubular elements to thereby form a bulk bag as defined above and also tubular elements for insertion into sleeves provided therefor in a bulk bag in order to form a bulk bag as defined above.

In order that the above and other features of the invention may be more fully understood one embodiment thereof will now be described with reference to the accompanying drawings.

DETAILED DESCRIPTION WITH REFERENCE TO THE DRAWINGS

Figure 1:
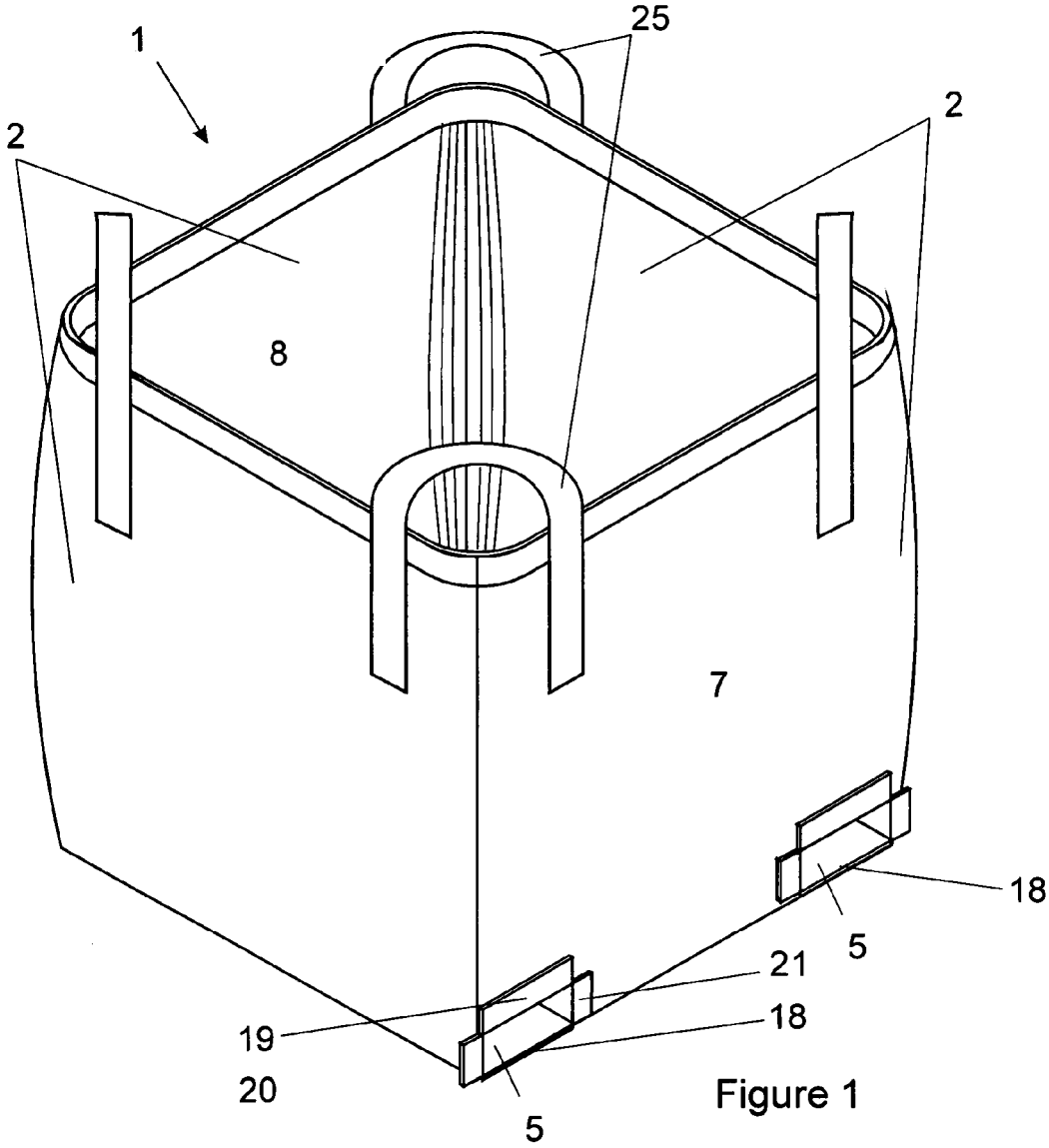
FIG. 1 is a schematic isometric illustration of a bulk bag according to the invention from the front, or "approach side" for a forklift truck and showing the front ends of the tubular elements.
Figure 4:
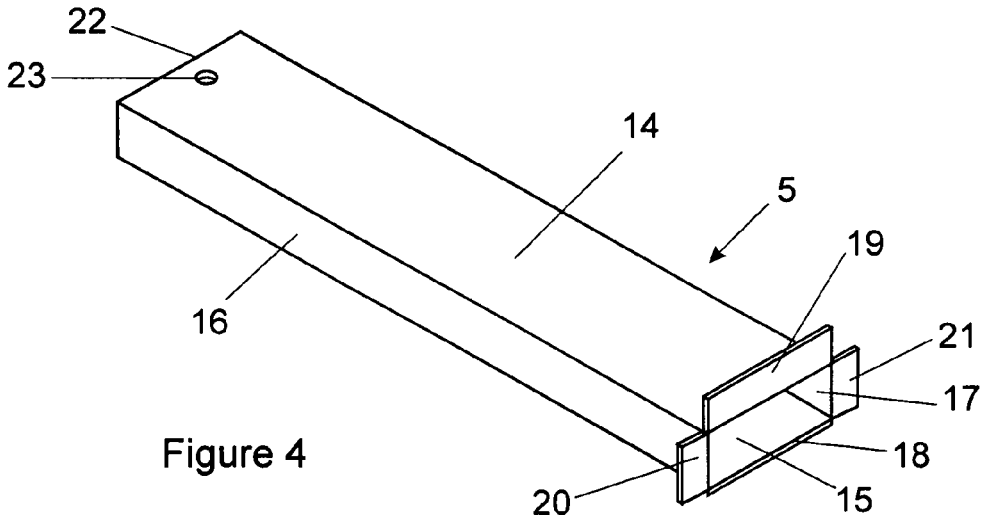
FIG. 4 is an enlarged schematic isometric view of a tubular element for insertion in a sleeve in the bag.
Figure 2:
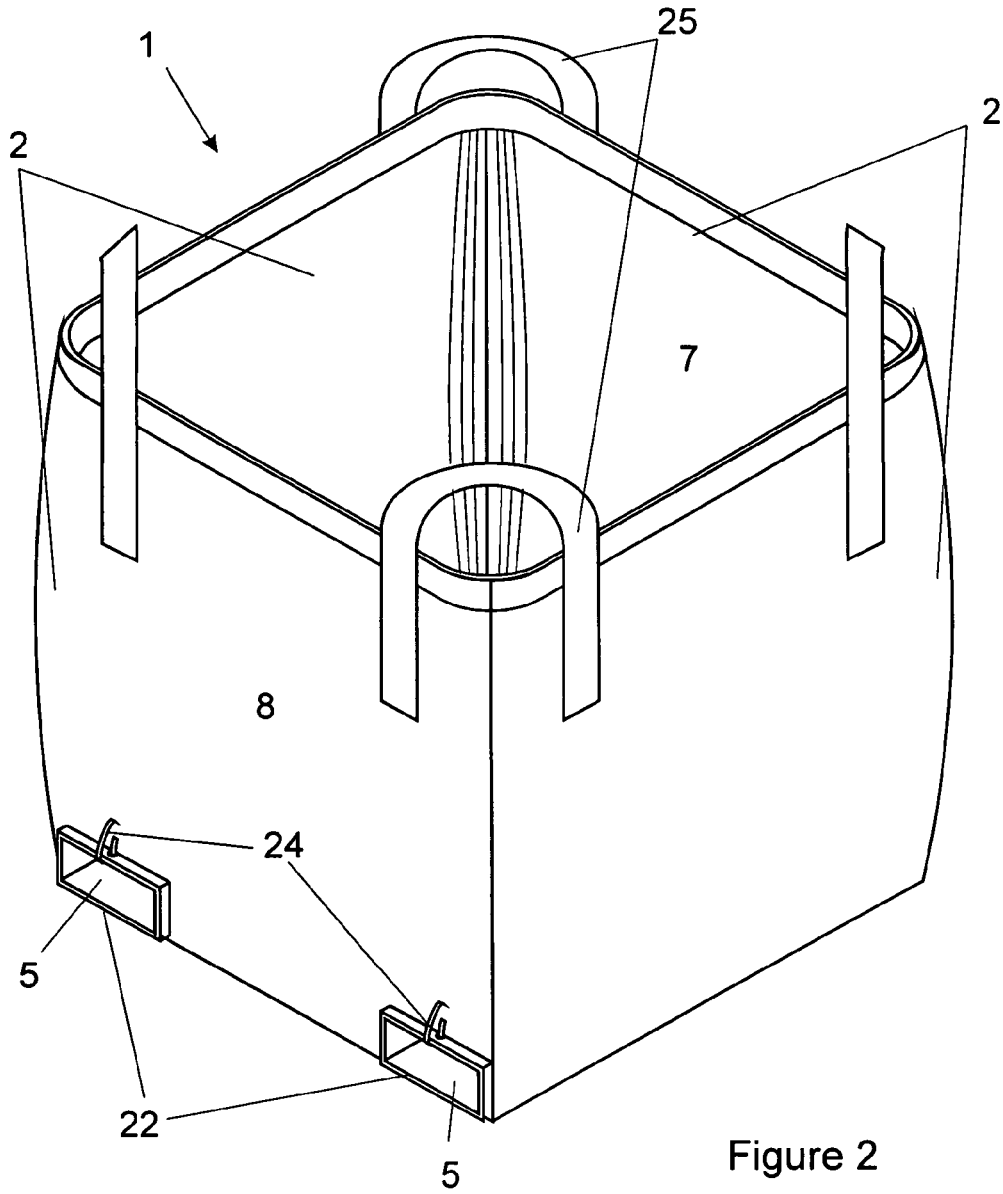
FIG. 2 is a view similar to FIG. 1 but taken from the opposite side of the bulk bag and showing the rear ends of the tubular elements.
Figure 5:
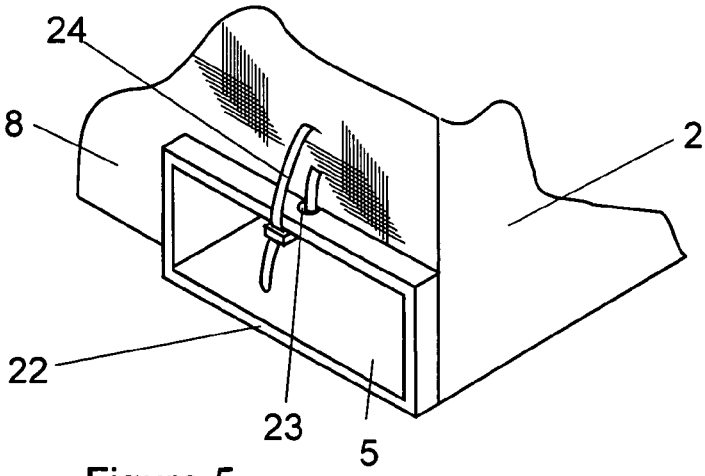
FIG. 5 is an enlarged detailed illustration of the rear end of a tubular element installed in a bag.
Figure 3:
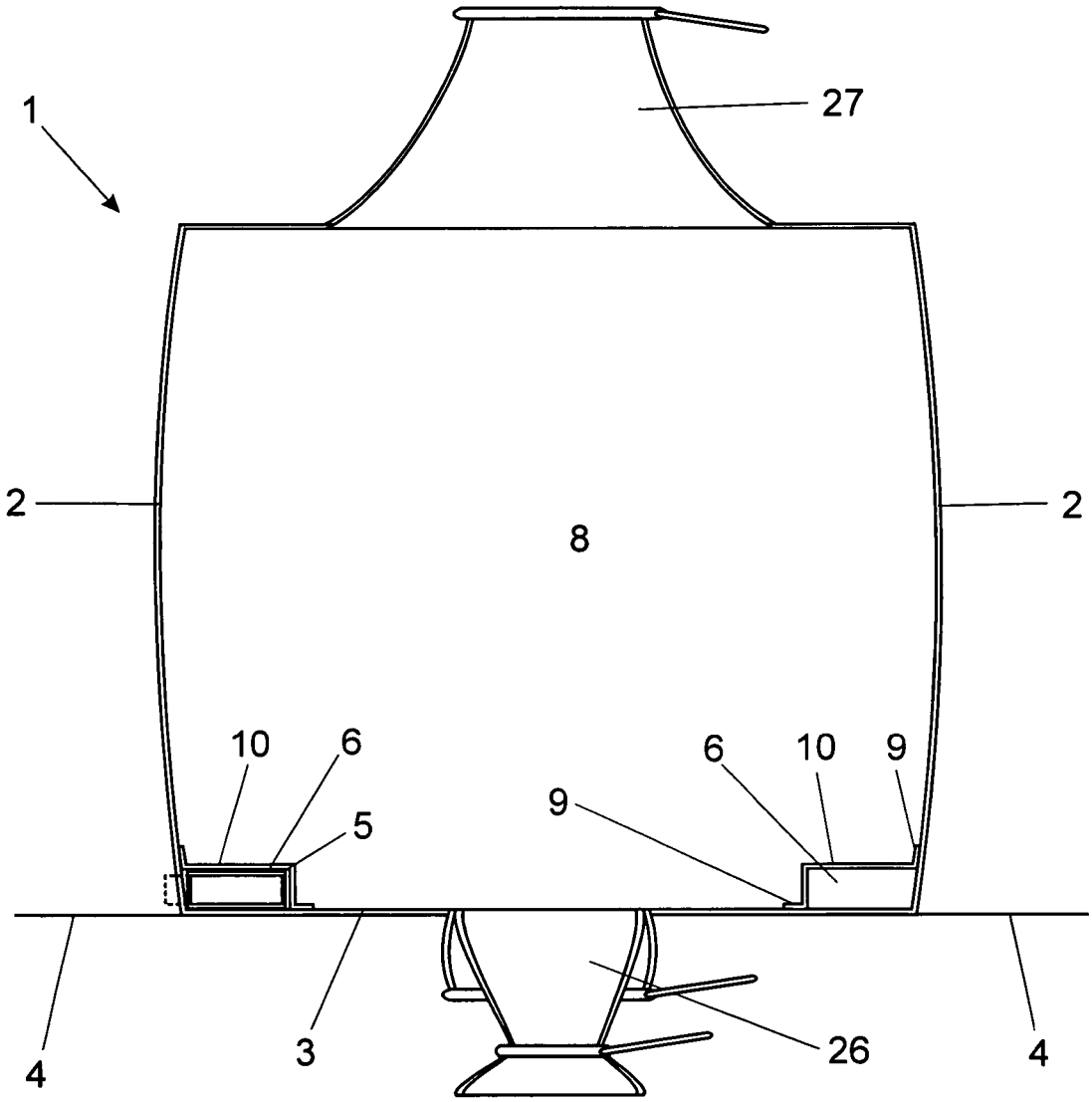
FIG. 3 is a schematic sectional elevation of the bulk bag illustrated in FIGS. 1 and 2 and illustrating some optional features of its construction.

In the illustrated embodiment of the invention, a bulk bag, generally indicated by numeral (1), is made by substantially conventional manufacturing techniques of cutting and stitching and/or thermally bonding a suitable woven fabric material, typically a woven polypropylene or other suitable material. The bulk bag has sidewalls (2) and a bottom wall (3), the bottom wall being adapted to rest on the ground or floor that is indicated by numeral (4) in FIG. 3. This arrangement means that the majority of the substantial weight of a filled bag is exerted directly on the floor and only a small portion is exerted on the tubular elements that described below.

In order to accommodate generally squat rectangular cross-sectioned tubular elements (5) that, in use receive the tines of a forklift truck, there are formed two sleeves (6) that extend generally parallel to each other, one in each corner of the bag where the relevant side wall joins the bottom wall so as to extend from what will be referred to herein as the front (7) of the bulk bag to what will be referred to herein as the rear (8) thereof. The sleeves are most easily formed by stitching the edges (9) of a strip of fabric (10) to the side-wall and bottom wall. Apertures are formed in the front wall and rear wall of the bag to provide open ends to the sleeves.

Each of the tubular elements (5) is made from extruded plastics sheet material that preferably has a series of stiffening ribs or webs extending in the direction of extrusion and that are arranged to extend transverse to the length of the tubular element.

Figure 7:
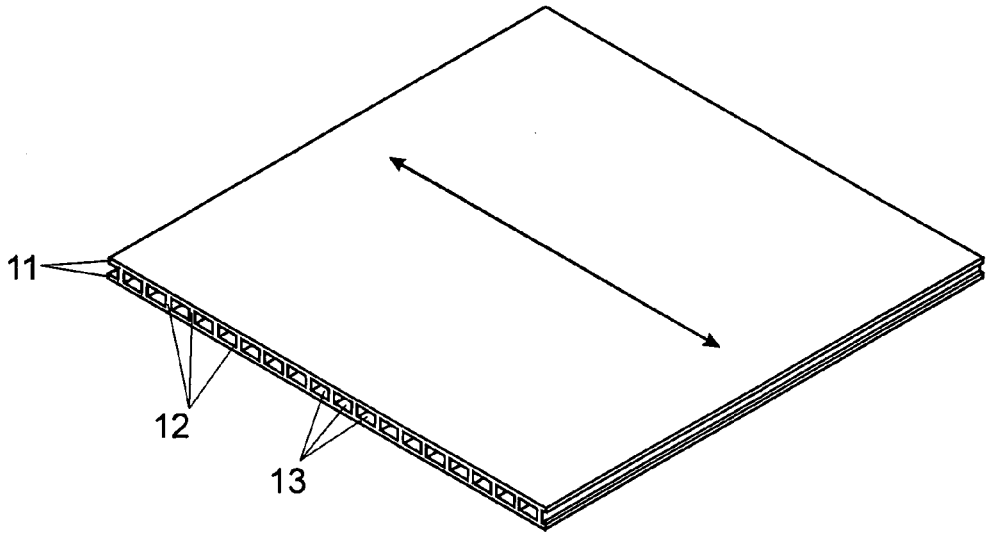
FIG. 7 is an isometric illustration of a small area of sheet material from which the tubular elements are made; and, FIG. 8 is a plan view of a cut blank sheet of material preparatory to bending along the lines indicated to form a tubular element for the bulk bag.

In this embodiment of the invention the extruded plastics sheet material (see FIG. 7) comprises a pair of spaced parallel walls (11) that are interconnected by a series of spaced parallel webs (12) of integral material that form a series of generally rectangular longitudinally extending cavities (13). A suitable sheet material is that termed "twin walled fluted cellular structural panel" and sold under the trademarks CORREX™ and CORRUPLAS™.

Figure 8:
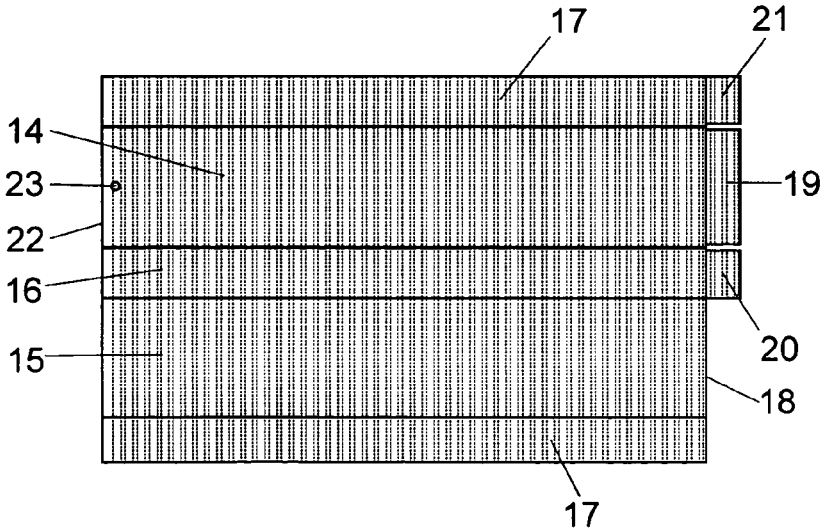

A tubular element is formed by cutting, typically die cutting, a sheet of such material to the shape illustrated in FIG. 8 that provides for a top wall (14); a bottom wall (15); a first side wall (16); and a double second side wall (17) the two walls of which are adjacent the two parallel free edges of the sheet. At the front end (18) is an extension (19) to the top wall and an extension (20, 21) to each of the sidewalls (16) and one of the thicknesses of the double side wall (17).

Figure 6:
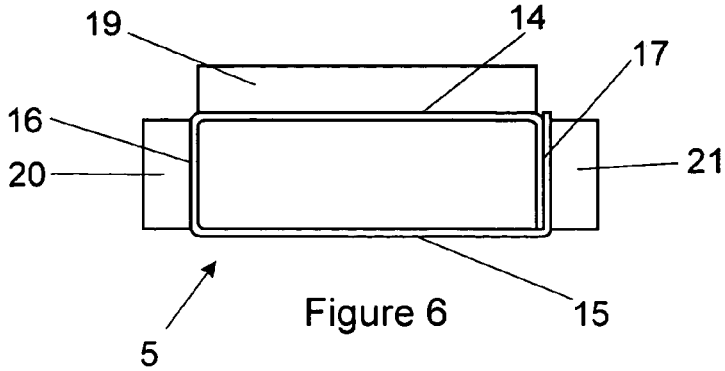
FIG. 6 is an end view of a tubular element taken from the rear end for purposes of clarity.

The relevant bend lines are all illustrated in FIG. 8 and the tubular element is formed by heating the sheet material along these lines to soften it and then forming the required bends to form the tubular construction illustrated most clearly in FIG. 6. The exact bending procedure can be varied widely and it is considered to be most expeditious for all lines of bend to be heated at the same time followed by bending of the sheet to form the tubular element that can be held in a jig while it cools and sets in the tubular configuration. As shown clearly in FIG. 6, in the final form the two second side wall zones overlap to form a double side wall. At the same time, or thereafter, the extensions (19, 20, 21) are bent outwards to extend at generally right angles to the associated wall of the tubular element so as to form flanges that are indicated by the same numerals as in FIG. 8.

As indicated above, the bends that form the corners of the tubular element are all made at right angles to the direction in which the webs extend that interconnect the pair of spaced walls of the sheet material so that excellent strength advantage is achieved.

Finally, the rear end (22) of the top wall of the tubular element has a perforation (23) formed therethrough, the purpose of which will be described below.

A tubular element of the type described above is inserted, one into each of the two sleeves, and it to be understood that the flanges (19, 20, 21) effectively form stops against the front of the bulk bag so as to prevent the tubular element moving further into the sleeve. The flanges serve a second important purpose in that they protect the immediately surrounding area of the bag itself from being damaged by the tines of a forklift truck in the event that the latter are not properly aligned during attempts to introduce them into the tubular elements, in use.

The rear end (22) of each of the tubular elements is then attached to the immediately adjacent area of the woven fabric of the rear wall by means of a simple cable tie (24) that is threaded through the perforation (23); into and out of the fabric of the bag and then fastened in its integral buckle in the usual manner. Such a cable tie prevents the tubular element from being withdrawn from the sleeve during use.

It will be understood that the bulk bag described above can be made to any configuration and may be fitted with the normal lifting straps (25); drawstring type of bottom outlet (26) or flexible funnel inlet (27) at the top.

Numerous variations may be made to the embodiment of the invention described above without departing from the scope hereof. In particular, the material from which the tubular elements are fabricated can be varied widely although it is preferred that they have reinforcing ribs or webs extending in a direction transverse to the length of the element itself. Also the manner in which the rear end of the element is attached to the bag can be varied widely.

The invention claimed is:

1. A bulk bag having flexible side walls; a bottom wall configured to define, with the sidewalls, a generally rectangular shape of bag; and a pair of laterally spaced generally flexible sleeves associated with the bottom wall, wherein each of the flexible sleeves are at least partially defined by the bottom wall and one of the flexible side walls, and wherein each of the flexible sleeves operatively receives a generally rigid tubular element adapted to receive a tine of a forklift truck, in use, and wherein each tubular element has, at one end thereof, outwardly directed flange formations for preventing movement of the said end into the sleeve, in use, and means at the other end for inhibiting movement of said other end into the sleeve, in use, and wherein said outwardly directed flange formations are formed by bends in the thermoplastic material from which the tubular element is made with the bends being at right angles to a length of the tubular shape.

2. A bulk bag as claimed in claim 1 in which the opposite end of each tubular element has a perforation through the material for operatively receiving a fastener attaching said opposite end to the adjacent wall of the bulk bag.

3. A bulk bag as claimed in claim 1 in which the laterally spaced sleeves are formed within the general rectangular shape of the bag such that, in use, the bottom of the bag is substantially coplanar with a bottom wall of each of the spaced sleeves.

4. A bulk bag having flexible side walls; a bottom wall configured to define, with the side walls, a generally rectangular shape of bag; and a pair of laterally spaced generally flexible sleeves associated with the bottom wall, wherein each of the flexible sleeves are at least partially defined by the bottom wall and one of the flexible side walls, and wherein each of the flexible sleeves receives a generally rigid tubular element adapted to receive a tine of a forklift truck, in use, and wherein each tubular element is made to a generally rectangular cross-sectional configuration and is composed of a sheet of thermoplastic material heat-shaped to form bends defining the generally rectangular cross-sectional configuration of said tubular element, and wherein one end of each tubular element has integral flange formations formed by bends in the thermoplastic material from which the tubular element is made with the bends being at right angles to a length of the tubular shape.

5. A bulk bag as claimed in claim 4 in which the thermoplastic material is an extruded sheet of plastics material having a series of integral spaced parallel webs or ribs of material strengthening the sheet.

6. A bulk bag as claimed in claim 5, wherein the bends defining the corners of said generally rectangular cross-sectional tubular element extend at substantially right angles to the length of said webs or ribs.

7. A bulk bag as claimed in claim 5 in which the free longitudinal edges of a sheet of thermoplastic material bent to the said tubular element configuration overlap and define a double wall at one side of the tubular element.

8. A bulk bag as claimed in claim 5 in which the sheet of thermoplastic material is an extruded polypropylene, polyethylene, or other plastics material having the configuration of two spaced parallel walls interconnected by a series of parallel integral webs of material.

9. A bulk bag as claimed in claim 4 in which the opposite end of each tubular element has a perforation through the material for operatively receiving a fastener attaching said opposite end to the adjacent wall of the bulk bag.

10. A bulk bag as claimed in claim 4 in which the laterally spaced sleeves are formed within the general rectangular shape of the bag such that, in use, the bottom of the bag is substantially coplanar with a bottom wall of each of the spaced sleeves.

* * * * *